United States Patent [19]

Calderaro

[11] 4,169,576

[45] Oct. 2, 1979

[54] FOLDABLE BEARER STRUCTURE FOR OUTER MOULDS

[76] Inventor: Dante R. Calderaro, Avellaneda St. 356, 1846 Adrogué (B.A.), Argentina

[21] Appl. No.: 862,568

[22] Filed: Dec. 20, 1977

[30] Foreign Application Priority Data

Dec. 20, 1976 [AR] Argentina ..... 265916

[51] Int. Cl.[2] ..... E04G 17/14

[52] U.S. Cl. ..... 249/188; 182/152; 249/210

[58] Field of Search ..... 248/167; 182/152, 156; 52/66, 68, 69, 70; 249/27, 185, 210, 188

[56] References Cited

U.S. PATENT DOCUMENTS

| | | | |
|---|---|---|---|
| 2,835,931 | 5/1958 | Sterkin | 52/70 |
| 3,280,796 | 10/1966 | Hatcher | 52/70 |
| 3,847,341 | 11/1974 | Stickler, Jr. | 249/27 |
| 3,926,403 | 12/1975 | Markewitz et al. | 249/27 |
| 4,035,964 | 7/1977 | Robinson | 52/66 |

*Primary Examiner*—John McQuade

*Attorney, Agent, or Firm*—Browdy and Neimark

[57] ABSTRACT

A foldable bearing structure for moulding outer surfaces comprises a main post to which are hinged upper and lower beams supported by diagonal elements, with side frames hinged by means of their vertical sides to the main post. The construction is light-weight and its cost is relatively low.

6 Claims, 8 Drawing Figures

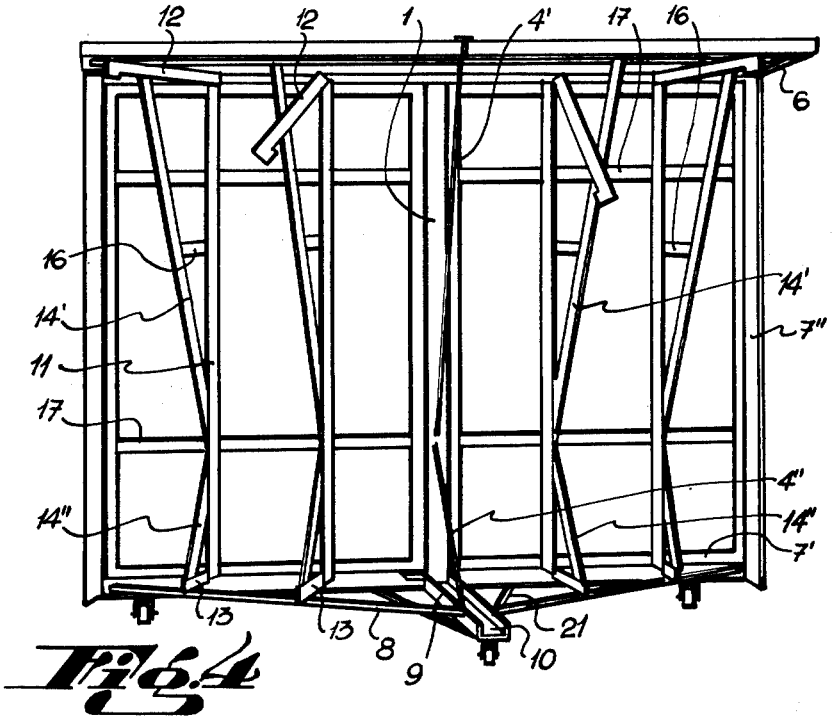
Fig.4
Fig.5
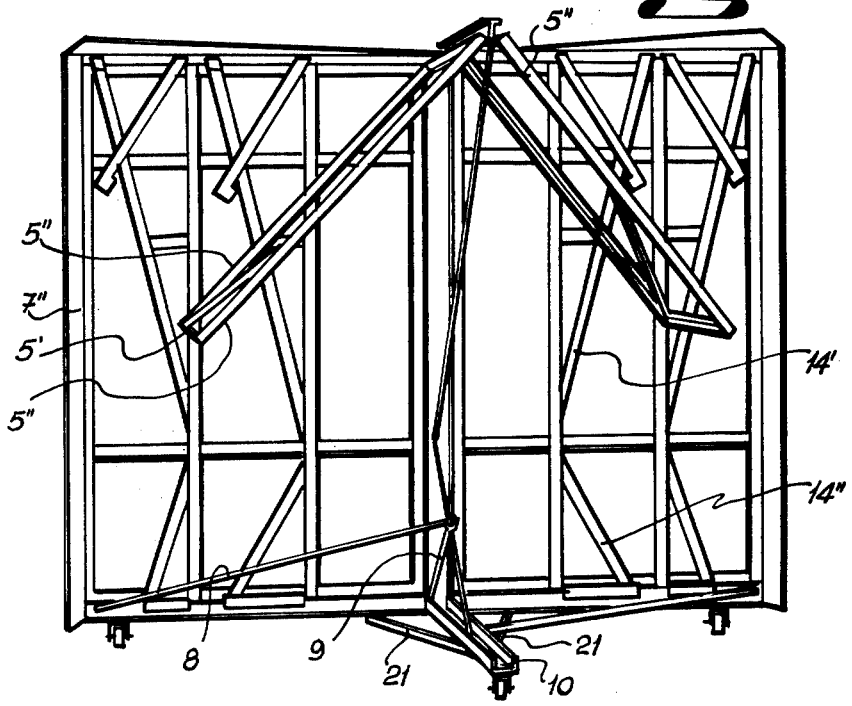

FOLDABLE BEARER STRUCTURE FOR OUTER MOULDS

BACKGROUND OF THE INVENTION

The present invention is related to a foldable bearing structure for moulding outer surfaces of vertical walls and their continuous or partial perimetric overhangs, in the shape of balconies and such like, provided with planes adapted to receive modulated sheets which, apart from being resistant, are capable of being provided with embossments, channels, etc. constituting utilitarian decorations, and, at the edges, sheets constituting sides of columns and bottoms of necks between the walls and the overhangs.

Removable structures for this purpose are known, but they are, as a rule, heavy, costly and difficult to handle in order to be brought to and removed from construction sites as well as to be mounted thereon.

The essence of the present invention resides in that the structure in question is light, its cost is relatively much lower than that of the known embodiments performing a similar task, and its weight does not require, as in the prior structures, elevator cranes or special transportation trucks, but it may be carried by conventional general purpose trucks and loaded onto or removed from the same at the site by a few workmen if trucks are used which do not carry their own loading and unloading equipment.

At the ends of its vertical wings this novel structure carries sheets constituting columns in such a way as to complete the inner moulds used jointly with these structures, and, moreover, it includes a rigid portal at the center of the span between the walls. In this way they bar efficiently the wings of the inner moulds and complement them.

An important feature of the structures in accordance with the present invention is characterized in that they are universal, i.e. they are capable of forming protruding angles (or corners) as well as inner angles, by removing the inner supplement whenever necessary. Likewise, they are capable of forming uninterrupted series where the project requires such constructions.

Another important feature is that they can be hoisted up onto and lowered from upper floors with the aid of conventional means, manual or motorized equipment, which exists at every site in order to hoist up or lower materials as, for instance, doors, windows and such like, and to pass through apertures practically of the same size as the minimum required for passing through the doors and windows.

An exemplary embodiment of the bearing structure for outer moulding surfaces according to the invention, includes a rigid central portal constituted by a main post, to the ends of which are fixed, on one and the same side, horizontal, coplanar upper and lower beams having their free ends secured diagonal stays at a point intermediate the main post. Two side frames are hinged by means of their vertical sides one on either side of the main post, to the horizontal sides of which frames are joined a plurality of removable secondary portals, similar to the rigid central portal and adapted for sustaining each an upper rectangle hinged by means of their smaller sides to said upper beam. A right-angled triangle is joined to each of the lower horizontal sides of the side frames, by means of their larger legs, while the smaller leg is adapted for nesting in channels provided in the said lower beam.

BRIEF DESCRIPTION OF THE DRAWINGS

For a better understanding of the nature of this invention and the manner in which the same can be put into practice, a preferred embodiment of same will now be given, with the aid of the appended drawings. It is to be understood, of course, that the said preferred embodiment is given merely by way of example and does not by any means limit the scope of the invention as defined in the foregoing paragraph.

In the appended drawings, where corresponding reference to equal parts:

FIG. 4 shows the same embodiment as FIG. 3, but with the structure in its folding step (that of the secondary portals);

FIG. 5 shows the folding of the upper rectangles and the lower triangles;

DETAILED DESCRIPTION OF THE PREFERRED EMBODIMENT

Figure 7:
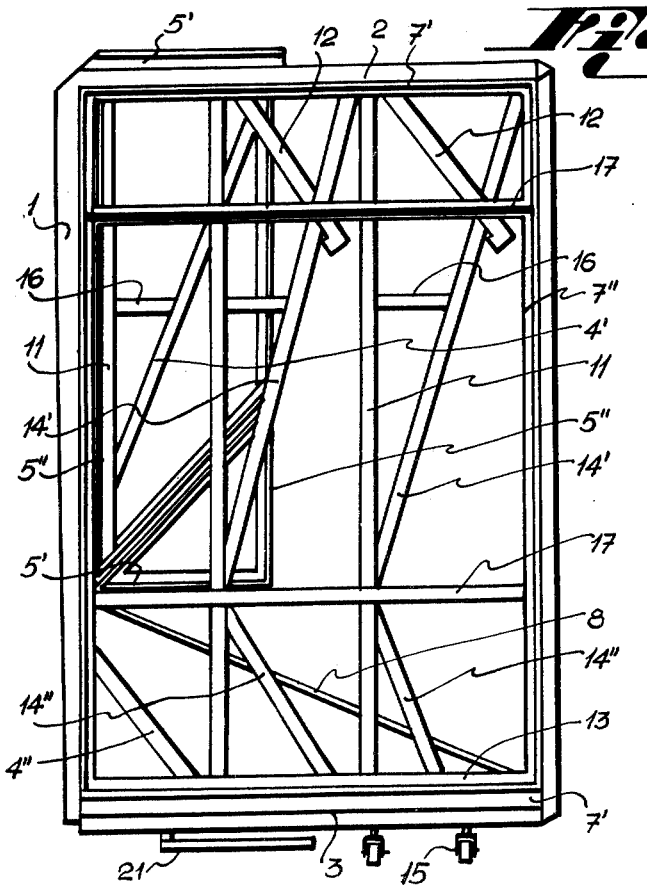
FIG. 7 shows the folded structure in a side view.

As may be seen from the drawings, especially from FIG. 7, the structure according to this invention includes a rigid central portal formed by a vertical post 1, an upper beam 2 and a lower beam 3 which are horizontal and secured to the post 1 by means of upper and lower diagonal stays 4' and 4'', respectively, the lower stay 4' being fixed between the post 1 and the lower beam 3. The upper stay 4 is fixed between the main post 1 and upper beam 2. Hinged to the post 1 there are frames comprised by horizontal sides 7' and vertical sides 7''. Hinged to the upper beam 2 there are rectangular structures comprised by the smaller side 5' and a larger side 5''. The frame of the sides 7' and 7'' are associated with cross members 17 and similarly as the rectangles of sides 5' and 5'' they define planes and are adapted for receiving plates having moulding surfaces (not shown).

Figure 3:
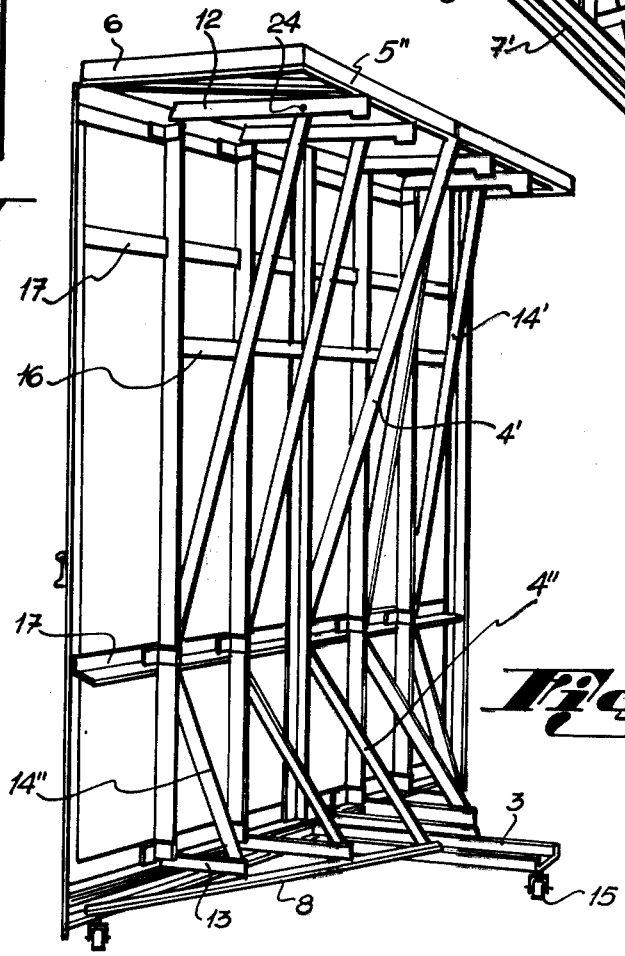
FIG. 3 shows, in perspective, the same embodiment as FIG. 2, but seen from the opposite end.

Hinged to the frames compared by the sides 7'-7'' there are secondary portals constituted by posts 11, upper beams 12, lower beams 13 and diagonal stays 14'-14'', similar to the rigid portal defined by the members 1-2-3 but differing from the same in that, apart from its thickness, the upper beams 12 are jointed to the upper end of post 11 and adapted for coupling (FIG. 3) by means of a bolt 24, to the upper diagonal stay 14'. Furthermore, the diagonal stays 14' are secured to the posts 11 by reinforcement bars 16. Hinged to the lower sides 7' by means of a larger leg, there is a right-angled triangular structure having a hypothenuse 8, the smaller leg 9 of which (FIG. 5) is adapted for entering into channel 10 provided on the upper face of the lower beam 3. This lower beam 3 and the lower sides 7' of the lateral frames carry, on its lower portion, casters 15 allowing the structure to roll when the same is folded as shown in FIGS. 1, 7 and 8.

Figure 6:
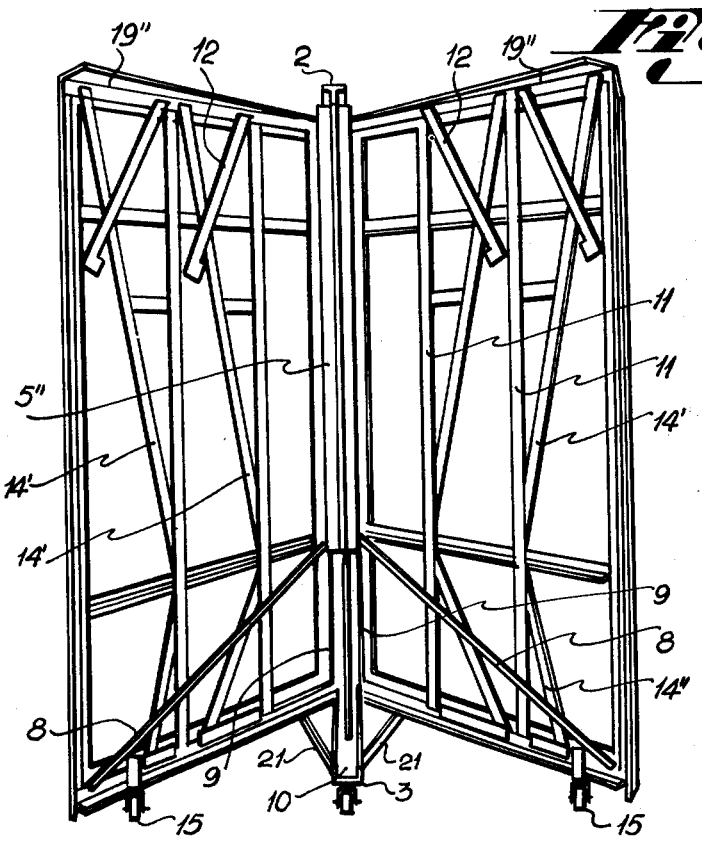
FIG. 6 shows the folding of the side frames.

The operation is as follows: The structure according to this invention, when folded (FIGS. 1, 7 and 8), may be loaded onto conventional, general purpose trucks and moved to the site and from there, rolling on the casters 15, to its final location. There the hook (see FIG. 2) is unhooked (FIG. 1) and the frames are spread out from the sides 7'-7", as shown in FIG. 6, to their coplanar position, as seen in FIG. 5, where they are secured by folding back the hypothenuse member 8 and the smaller leg 9 as far as to lodge the latter in the corresponding channel 10 of the lower beam 3 of the main portal. Subsequently, the rectangles of sides 5'-5" are put into a horizontal position, as shown in FIG. 5 and, once they are horizontal, as shown in FIG. 4, the secondary portals are folded back so as to locate the horizontal beams 12-13 and their corresponding diagonal stays 14'-14" in planes perpendicular to the sides 7'-7", whereupon, by means of a bolt 24, the connection 12-14' is made. The upper horizontal beams 12 serve then as a bearing for the frames of sides 5'-5", and the beams 13 rest on the hypothenuse member 8. The structure may be provided, at the planes defined by the frames 7'-7" and the rectangles 5'-5", with the sheets constituting the moulding surfaces, whereupon concrete may be poured.

Figure 1:
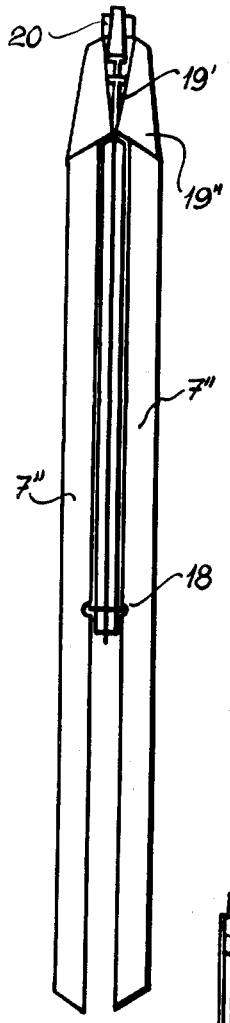
FIG. 1 shows, in perspective, the structure according to this invention, folded and seen from the end which is closed by means of a hook.
Figure 8:
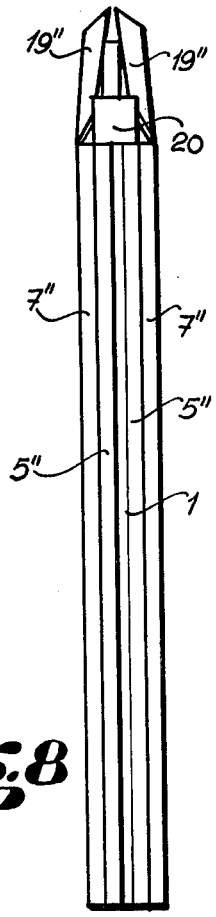
FIG. 8 shows the folded structure seen from the side opposite the one showed in FIG. 1.

In order to dismantle the structure, these operations are carried out in reverse sequence, whereby the folded structure of FIGS. 1, 7 and 8 is obtained which may be moved to any desirable location.

Figure 2:
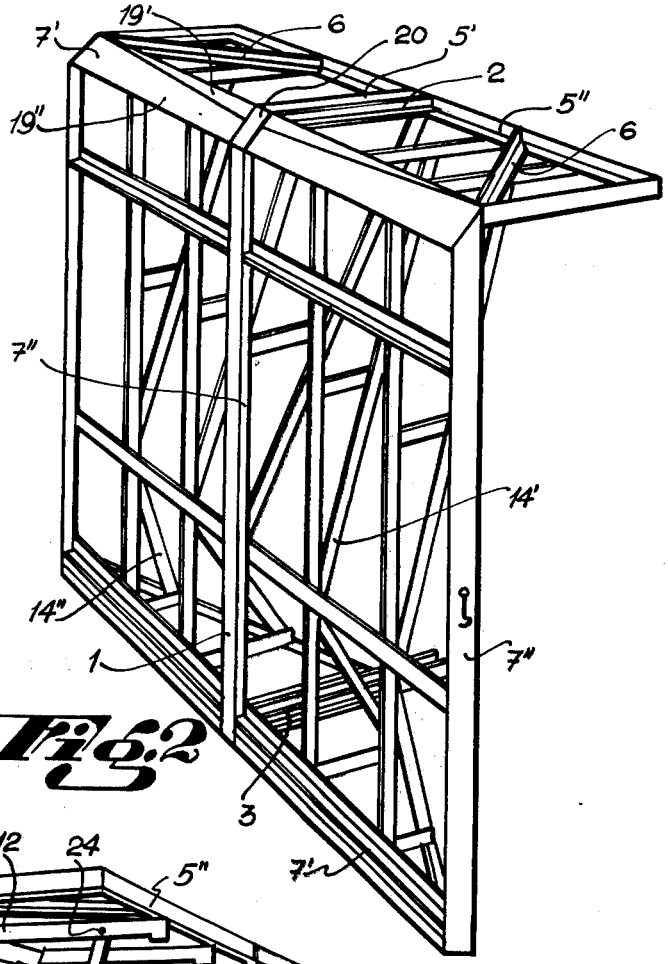
FIG. 2 shows, in perspective, the same structure, but unfolded and seen from the side where the sheets constituting the moulding surfaces will be applied.

It is obvious that many modifications of detail may be made in the embodiment as described, such as: providing the sides 5" with bevels, to which are fixed sheets 19' defining the necks between the overhang and the moulded wall and which are complemented by means of sheets 19" applied to the sides 7' of frames 7'-7" as may be appreciated in FIGS. 1, 2 and 8; applying a sloping sheet 20 to the upper end of post 1 (FIGS. 2 and 8); and improving the coupling of the lower beam 3 with the frames of sides 7'-7" by means of tie rods 21 (FIGS. 4, 5, 6 and 7), on end of which is jointed to the lower side 7', while the other one is jointed to a bolt of the usual type sliding in a channel (not visible), located on the lower side of the lower beam 3, however, all such modifications, as well as others, fall within the scope of this invention as defined in the following claims.

What I claim is:

1. A foldable bearing structure for outer moulding surfaces, the structure comprising, in combination a rigid central portal constituted by a main post, to respective ends of which are fixed, on one and the same side, respective horizontal, coplanar upper and lower beams having their respective free ends secured, by diagonal stays, at a point intermediate said ends of said main post; two side frames hinged along their respective vertical sides one on either side of said main post; a plurality of secondary portals hinged to said frames, said secondary portals being operatively arranged to support upper rectangularly shaped structures hinged along one of their respective smaller sides to said upper beam; respective right-angled triangular shaped structures joined to each of the lower horizontal sides of said side frames, one of the legs of each of said right-angled triangular structures being arranged for nesting in channel means provided in said lower beam.

2. A foldable structure as set forth in claim 1, wherein said secondary portals rest, at their bottom portions, on the right-angled triangular shaped structures.

3. A foldable structure as set forth in claim 1, wherein lower sides of said frames and said lower beam are provided with casters.

4. A foldable structure as set forth in claim 1, including horizontal reinforcing bars provided to reinforce said portals.

5. A foldable structure as set forth in claim 1, including horizontal cross members forming part of said frames.

6. A foldable structure as set forth in claim 1, wherein said frames and said rectangular shaped structures define planes and are adapted for carrying plates having moulding surfaces thereon.

* * * * *